United States Patent [19]

Jonker

[11] Patent Number: 4,634,251

[45] Date of Patent: Jan. 6, 1987

[54] APPARATUS FOR DEVELOPING PHOTOGRAPHS AND PHOTOGRAPHIC STRIPS

[75] Inventor: Johan Jonker, Enschede, Netherlands

[73] Assignee: 501 Elektrotechnisch Bureau Moekotte B V, Enschede, Netherlands

[21] Appl. No.: 619,597

[22] PCT Filed: Oct. 8, 1982

[86] PCT No.: PCT/NL82/00033

§ 371 Date: May 29, 1984

§ 102(e) Date: May 29, 1984

[87] PCT Pub. No.: WO84/01629

PCT Pub. Date: Apr. 26, 1984

[51] Int. Cl.[4] ..... G03D 13/04

[52] U.S. Cl. ..... 354/312; 354/323; 354/324; 354/330

[58] Field of Search ..... 354/307, 312, 313, 315, 354/323, 329, 330, 299, 324

[56] References Cited

U.S. PATENT DOCUMENTS

| | | | |
|---|---|---|---|
| 3,703,860 | 11/1972 | Wilkinson | 354/329 |
| 4,005,463 | 1/1977 | Kowalski | 354/307 |
| 4,035,818 | 7/1977 | King | 354/323 |
| 4,169,671 | 10/1979 | Culler | 354/312 |
| 4,219,269 | 8/1980 | Bernhardt | 354/307 |
| 4,227,794 | 10/1980 | Tabin | 354/330 |
| 4,248,514 | 2/1981 | Watkins | 354/312 |
| 4,277,159 | 7/1981 | Descotes | 354/312 |
| 4,346,979 | 8/1982 | Faubert | 354/329 |

FOREIGN PATENT DOCUMENTS

| | | |
|---|---|---|
| 0043493 | 2/1982 | European Pat. Off. . |
| 2027048 | 12/1970 | Fed. Rep. of Germany . |
| 2735447 | 2/1978 | Fed. Rep. of Germany . |
| 2753943 | 6/1979 | Fed. Rep. of Germany . |
| 1093348 | 11/1967 | United Kingdom . |

*Primary Examiner*—A. A. Mathews

*Attorney, Agent, or Firm*—John P. Snyder

[57] ABSTRACT

The invention relates to an apparatus for developing photographs, inter alia color photographs and photographic strips with the aid of a developing drum adapted to be heated "au bain-marie" and to be rotatably driven about its longitudinal axis, to and from which drum the fluids required for development can be supplied and evacuated respectively. The invention has for its object to design such an apparatus in a manner such that during the developing process the temperature is maintained very constant so that in particular color photographs can be printed with very high, constant quality.

For this purpose the apparatus embodying the invention is characterized in that apart from the developing drum all stock containers for the fluids required for development are disposed in liquid bath forming the developing drum and held therein during development.

24 Claims, 10 Drawing Figures

Figure 1:
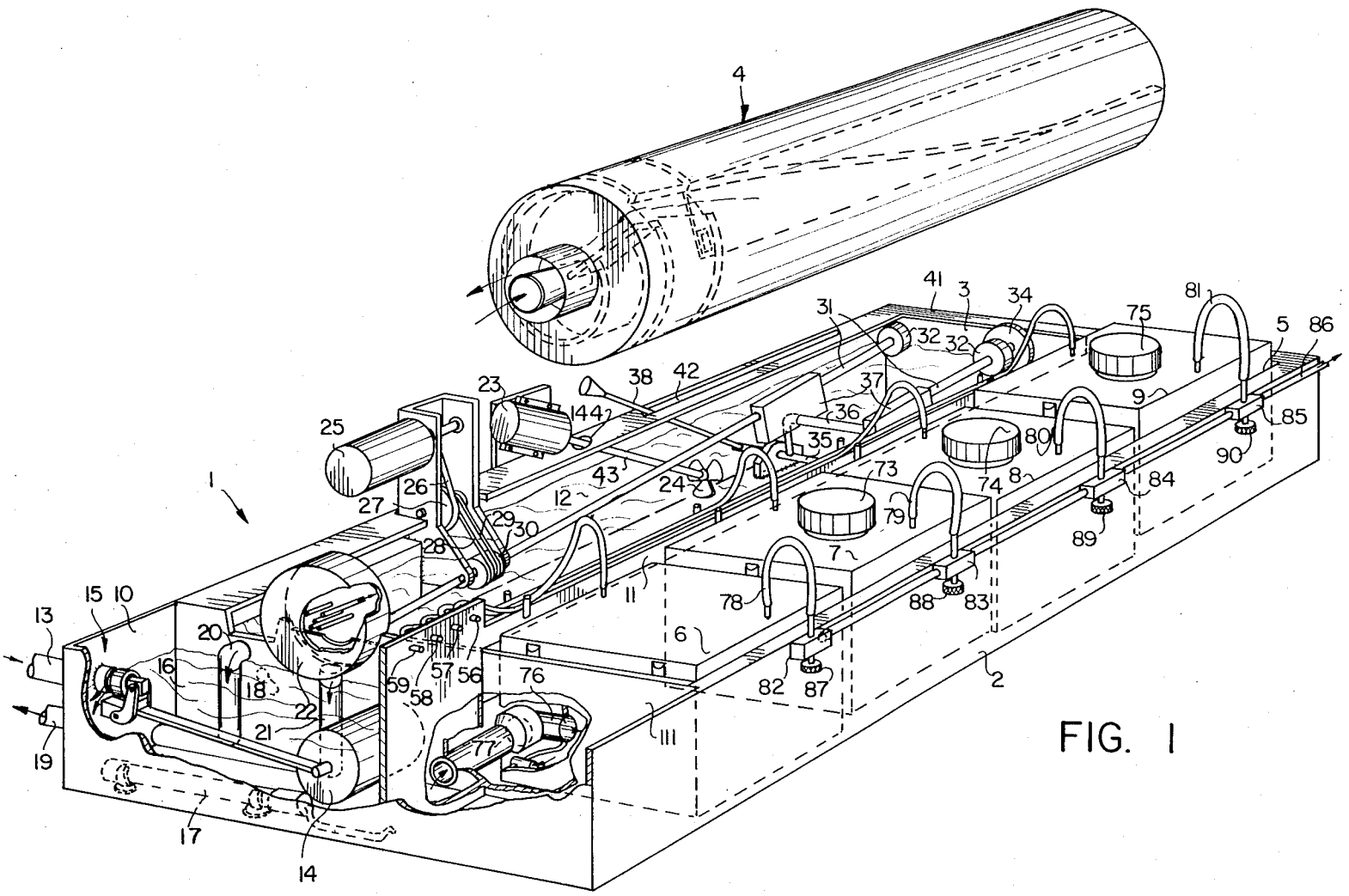

FIG. 5
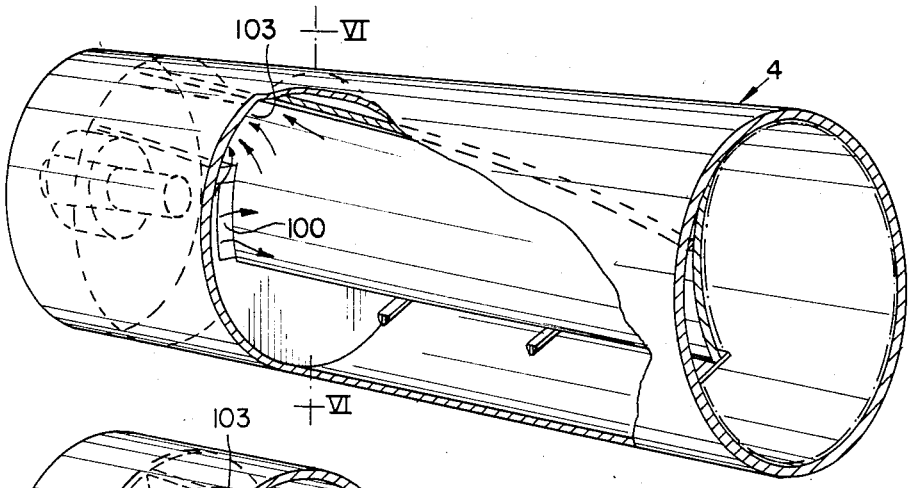
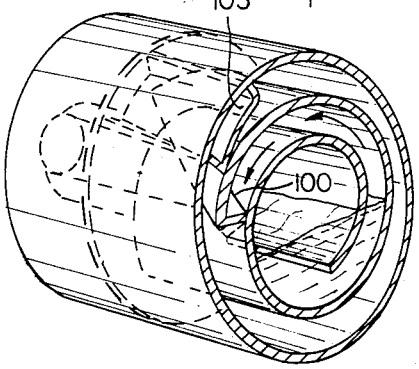
FIG.6
FIG.9
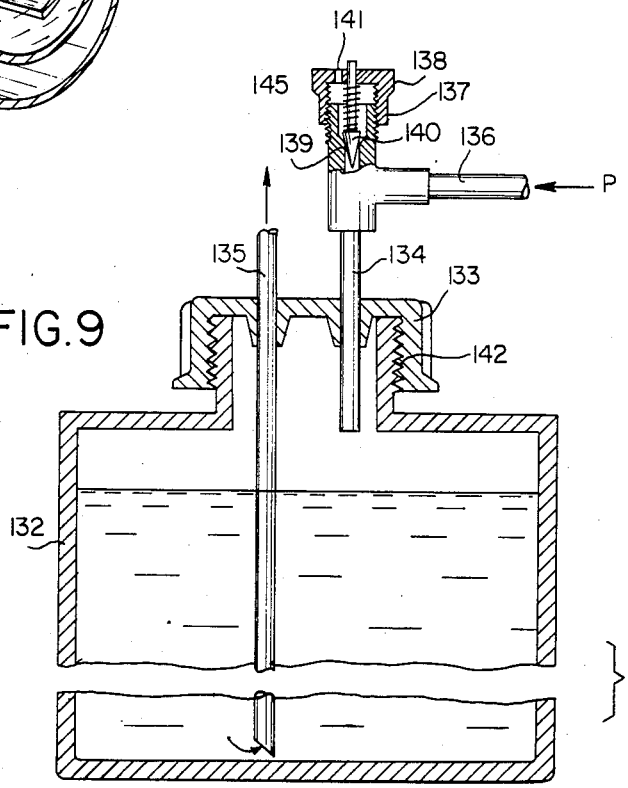

APPARATUS FOR DEVELOPING PHOTOGRAPHS AND PHOTOGRAPHIC STRIPS

The invention relates to an apparatus for developing photographs inter alia colour photographs and photographic strips with the aid of a developing drum that can be heated "au bain-marie" and be driven rotatably about its longitudinal axis, to which and from which the fluids required for the development can be fed and evacuated respectively.

Such an apparatus is commercially available. In this known apparatus the developing drum can be closed by means of a cover. For introducing and evacuating the fluids required for development the drum has, each time, to be lifted out of the heating bath, after which the introduction and/or evacuation of fluids can be manually carried out.

The very serious disadvantage thereof is that the temperature of the developing process is insufficiently controlled. It should be noted that the temperature fluctuations in a developing process of colour photographs must not exceed an order of magnitude of 0.3° C. Obviously the known developing apparatus cannot satisfy this requirement so that the inadequate control of the process may result in great differences of colour reproduction. Usually the developing drum is cleaned by flushing with tap water so that it is drastically cooled. A limitation of the known device resides in that in consequence of the large number of processes involved in the development, particularly of colour photographs the probability of faults, for example, inaccurate dosing or false time setting is inadmissibly high. In practice it is found that this limitation gives rise to deviations from the desired dosings and times and hence to colour differences.

Summarizing it is noted that the prior art is not sufficiently capable of controlling the temperature during all process steps of development and the setting of the required time intervals in a manner such that even utmost care cannot sufficiently guarantee that photographs of constant colour quality can be produced.

The invention has for its object to obviate the mentioned drawbacks and limitations of the prior art and provides to this end apparatus of the kind set forth in the preamble, in which not only the developing drum but also all stock containers for the fluids required for development are placed in the fluid bath heating the developing drum and held therein during development.

Preferably the developing drum comprises three coaxial compartments separated by transverse partitions, the first serving to receive the photograph or photographic strip to be developed, for which purpose it is closed at its free and remote from the transverse partition by a liquid-tight cover, the second containing means for supplying the fluids required for development in a liquid-tight and light-tight manner and the second and third compartments comprising means for the introduction and evacuation of the fluids used in a light-tight manner.

A given embodiment is characterized in that the second compartment has a spiral-shaped wall of more than 360° extending around the rotary axis, the inner space of which communicates with one or more feeding ducts for the or all fluids required for development and the outer space is closed at its end by a partition and is in open commucation through an orifice in the transverse partition with the first compartment and in that the third compartment also has a spiral-shaped wall extending around the rotary axis, the outer end of which is in open communication channel extending across the second compartment along the peripheral wall thereof with the first compartment and the inner space is in open communication with a central outlet orifice The first compartment preferably comprises a shell plate extending along the whole length thereof, the communication channel being connected below said shell plate with the third compartment.

In a preferred embodiment the stock containers can be subjected to gas pressure and selecting and dosing means are provided for successively feeding at will and in the desired amounts the fluids required for development to the second compartment.

Very simple is the embodiment in which the stock containers communicate with a common source of pressurized gas, for example air or nitrogen, and each of them communicated through an adjustable choke with the atmosphere. By setting the respective chokes the amount of fluid supplied per unit time can be fixed at will. In this way expensive pump means can be dispensed with.

In order to ensure most accurate dosing it is preferred to keep the fluid level in the stock containers always at least substantially constant, that is to say, independent of the filling degree of the stock containers, so that at a given pressure the level gauge is invariably constant. In this regard it is preferred to use floating stock containers.

A very reliable automatic operation is ensured by using a central control-unit for controlling the rotation of the developing drum and the synchronous energization of the selection and dosing means.

The invention will now be described more fully with reference to the drawing of a few arbitrarily chosen embodiments.

The drawing shows in

Figure 2:
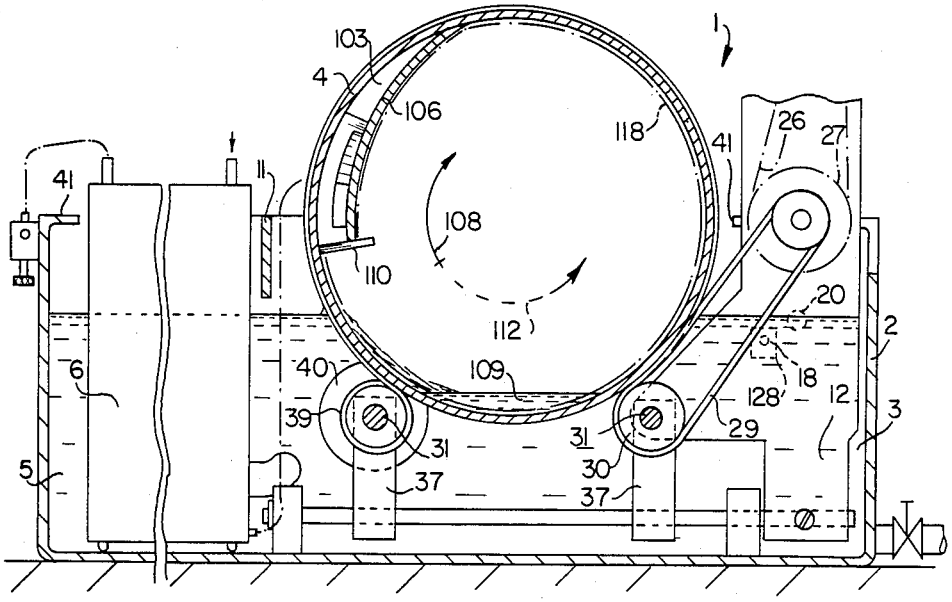
Figure 8:
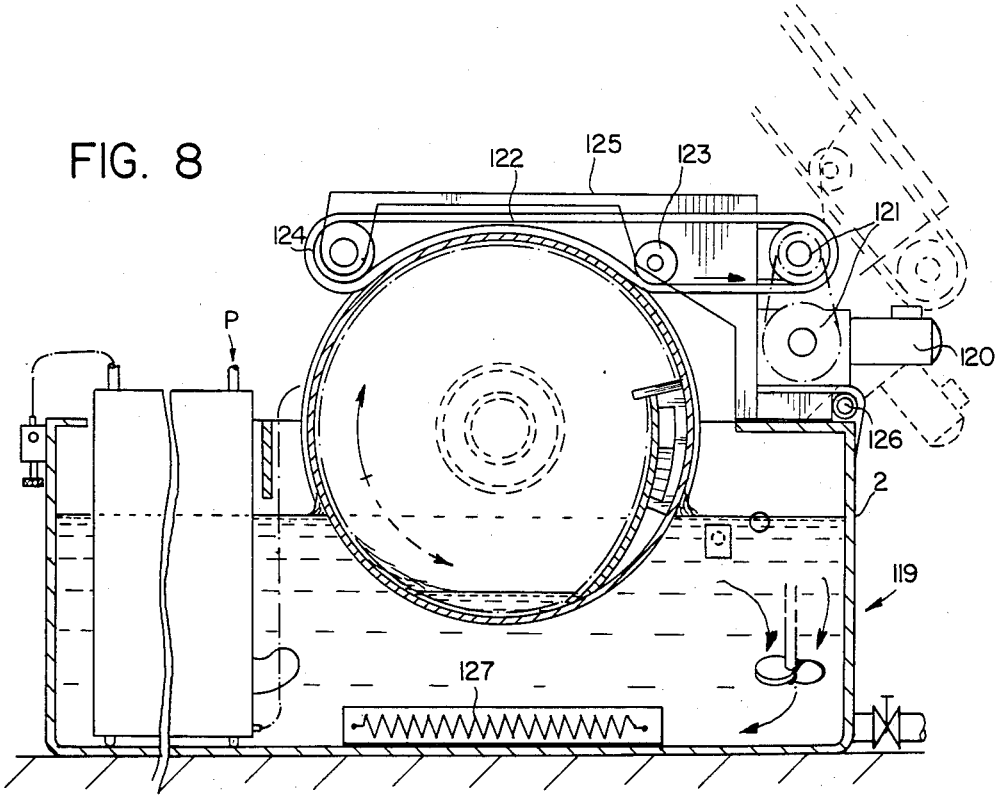
Figure 3:
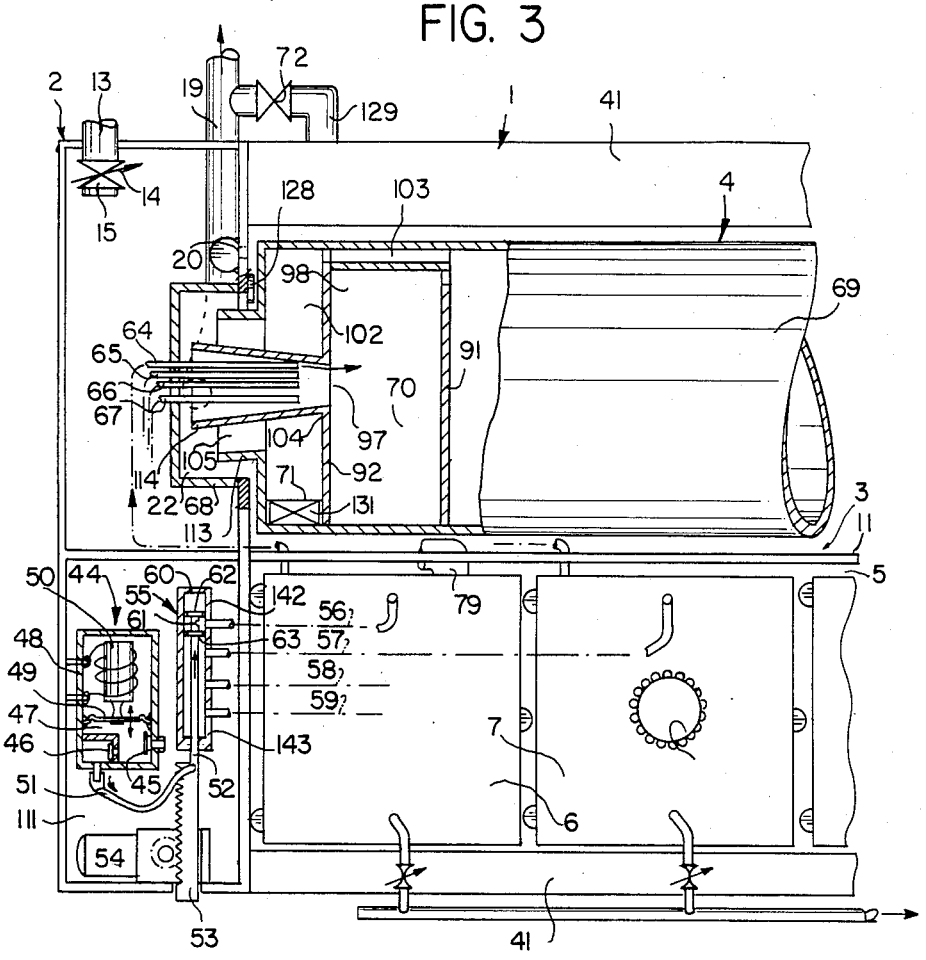
Figure 10:
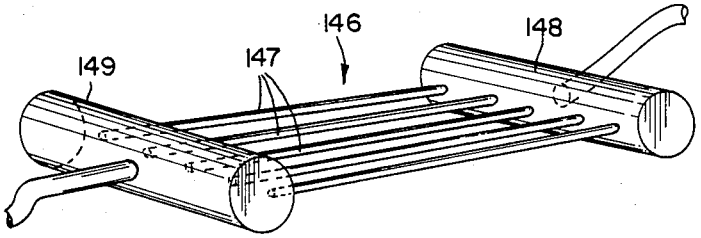
Figure 4:
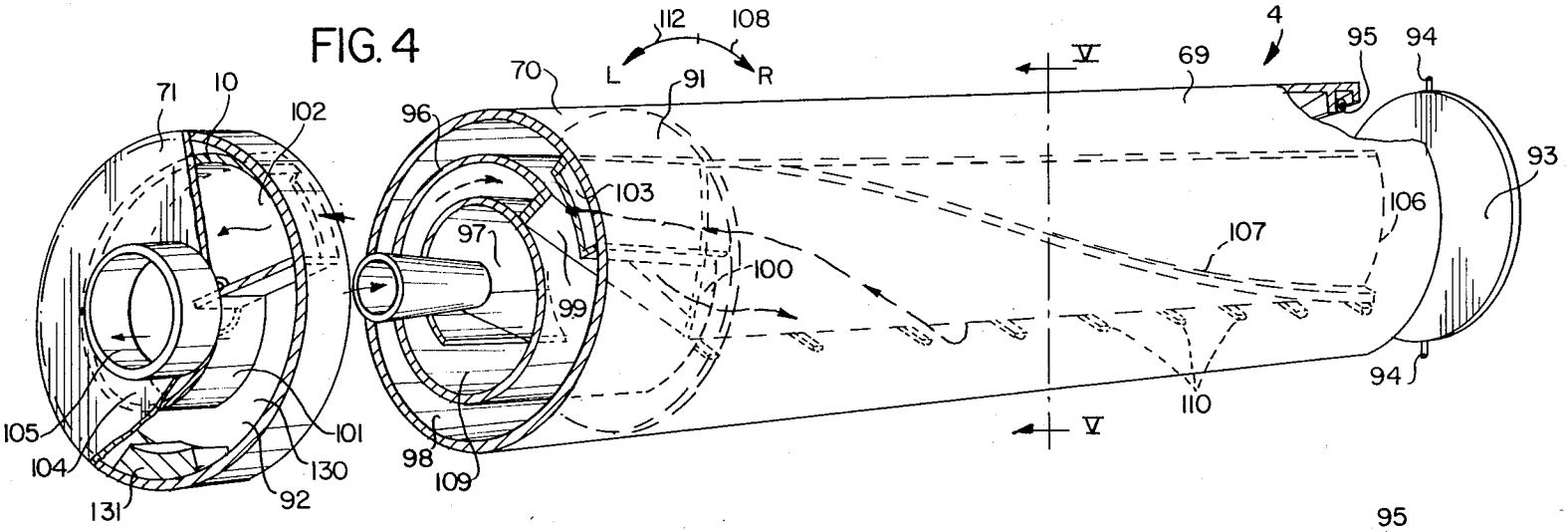
Figure 7:
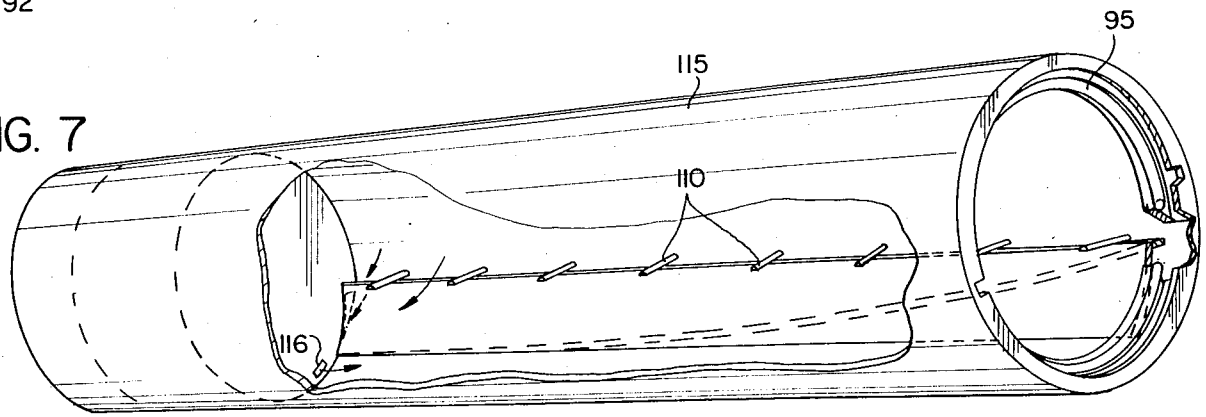

FIG. 1 a perspective view, partly broken away, of an embodiment of the apparatus in accordance with the invention FIG. 2 a cross-sectional view of the device of FIG. 1, FIG. 3 a plan view of part of the device of Fig. 1, FIG. 4 a perspective, fragmentary view of a developing drum embodying the invention, some components being shown for the sake of clarity at relative, radial distances, FIG. 5 a perspective, fragmentary view of the developing drum shown in FIG. 4, FIG. 6 a perspective view of part of the developing drum of FIG. 5, viewed away from the plane VI—VI, FIG. 7 a perspective, fragmentary view of a preferred embodiment of the developing drum in accordance with the invention, FIG. 8 a sectional view corresponding to FIG. 2 of a further embodiment of the device in accordance with the invention, FIG. 9 a stock container having a closing cap provided with the various ducts and FIG. 10 a perspective view of a heat exchanger connected between the developer container and the injection piece.

FIG. 1 shows a developing device 1 in a first embodiment of the invention. This device comprises a trough 2 having a plurality of separated spaces to be described more fully hereinafter. A first space 3 serves to accommodate at least partly a developing drum 4. The second space 5 may comprise four stock containers 6, 7, 8, 9. A third space 10 serves as a buffer and preheating space and a fourth space 111 accommodates mechanic control- and actuating means to be described hereinafter. The first space 3 is not separated from the second space 5, though between them there is a rim for limiting the freedom of movement of the stock containers 6 to 9. In this way it is achieved that the water contained in the first space 3 rinses in addition the stock containers 6 to 9 so that it is ensured that during operation the developing drum 4 has the same temperature as the fluids required for development in the stock containers 6 to 9.

With the third space 10 communicated a cold water supply duct 13. A valve 15 regulated by a float 14 provides a substantially constant level of water 16 in the space 10. The space 10 comprises furthermore a heating element 17 with a thermostat.

Through a narrow orifice 18 having a non-return valve 128 formed by a thin, flexible skin fastened by its upper edge to the associated wall, the third space 10 communicates with the first space 3 and the second space 5. Owing to the buffer effect of the space 10 in conjunction with the narrow passage of the orifice 18 the resultant is such that the heating element 17 can sufficiently rapidly heat the water 16 without giving rise to temperature fluctuations in the area of the developing drum 4.

There is furthermore provided an outlet 19 communicating on the one hand with the spaces 3 and 5 via an overflow 20 acting at a slightly higher level than the orifice 18 and on the other hand through an outlet duct 21 with outlet means 22 to be described more fully hereinafter for conducting fluids used for development away from the drum 4.

In order to ensure a most homogeneous temperature the second space 5 is provided with a stirrer 24 driven rotatably by a motor 23.

For rotatably driving the developing drum 4 a motor 25 drives through a rope 26 and a wheel 27 two ropes 28, 29 passing around a reversing roller 30. This reversing roller 30 is coupled with a frame 31, which is provided on the other side with carrying rollers 32, 33 for rotatably supporting the drum 4. The carrying roller 33 is furthermore provided with a flange 34 which serves as a stop member for limiting the freedom of axial movement of the drum 4.

In order to facilitate the introduction and removal of photographs into and out of the drum 4 respectively the frame 31 is tiltable by means of an eccentric cam shaft 36 tiltable about a tilting shaft 35 for co-operation with the frame 31 through blocks 37. The tilting shaft 35 is coupled with a control-lever 38.

Before going over to the further Figures it is noted that herein the same reference numerals are used.

FIG. 2 shows more clearly than FIG. 1 how the developing drum 4 is driven by the ropes 28, 29. The reversing roller 30 serves in addition as a carrying roller. There is furthermore provided a carrying roller 39 having a flange 40 which correspond with the carrying roller 33 and the flange 34 respectively, the arrangement being such that the drum 4 has only slight freedom of axial movement. It should be noted that in this embodiment the upper run of the rope 29 is in direct contact with the drum 4 in order to avoid slip of the rope with respect to the wheel.

FIG. 1 clearly shows the presence of a bent-over rim 41 at the top side of the upright walls of the trough 2. An elongate hole 42 allows the control-lever 38 to pass through the rim 41. The shaft 43 of the stirrer 24 passes through a hole 144 in the rim 41.

FIG. 3 shows in a plan view important structural details of the first embodiment of the device in accordance with the invention so far described.

The fourth space 111 comprises a diaphragm pump 44 having an air inlet valve 45 and an air outlet valve 46, between which valves 45 and 46 a pump space 47 is bounded by the wall 48 of the diaphragm pump 44 and a diaphragm 49, which can be caused to vibrate by alternating-current energization by a solenoid 50. Through a flexible hose 51 the air outlet valve 46 communicates with a hollow piston rod 52 provided with a toothed rack 53 co-operating with a step motor 54 in a manner such that the active end 55 of the piston rod 52 can be placed in a plurality of selectable positions. These various positions correspond to the points of connection of pressure ducts 56, 57, 58, 59 on a cylinder 60 communicating with the stock containers 6, 7, 8 and 9 respectively. Through an opening 61 between two sealing rings 62, 63 at the active end 55 one of the stock containers 6 to 9 can be selectably subjected to the air pressure. Pressure equalisation in front of and behind the piston with the ambience takes place through orifices 142, 143. The stock containers 6 to 9 are connected with fluid ducts 64, 65, 66 and 67 respectively, which open out via a conically tapering sheath 144 in an inlet and outlet hood 68 adjoining the drum 4 in the state of operation. The sheath 114 terminates by its broad end between the drum 4 and the hood 68 for conducting away fluid dripping from the ducts 64, 65, 66, 67.

From FIG. 3 it will be apparent that the developing drum 4 comprises three compartments i.e. a first compartment 69 for receiving a photograph or plain film to be developed, a second or inlet compartment 70 and a third or outlet compartment 71.

As will be seen in FIG. 3, the outlet 19 can be directly connected with a waste water outlet, for example, one or more tanks for used chemicals.

The selection of the various tanks intended each for one of the fluids can be carried out by a control coupled with that of the step motor 54. The outlet 19 is adjoined by an outlet 129 of the first space 3. The outlet 129 comprises an outlet valve 72 that can be closed. The valve 15 with the float 14 added to the cold water supply duct 13 are shown only schematically in FIG. 3. The float 14 is adjusted to a water level lying between that of the orifice 18 and the overflow 20.

Before discussing the details of the developing drum 4 with reference to FIG. 4 it is noted, partially referring back to FIG. 1, that the stock containers 7, 8, 9 are provided with filling caps 73, 74, 75 for filling these stock containers with the required chemical fluids. The stock container 6, however, is not provided with a filling cap, but it is connected with a water supply duct 76. This water supply duct 76 communicated through a non-return valve 77 with the buffer and preheating space 10 so that preheated water can be fed to the stock container 6. The water contained in the stock container 6 is used first for presoaking during development as flushing water and subsequently for cleaning the developing drum 4.

Referring to FIG. 1 the stock containers 6, 7, 8, 9 are provided with flexible ducts 78, 79, 80 and 81, the other ends of which are connected with adjustable chokes 72, 83, 84 and 85. These chokes 82 to 85 are connected in common with a gas exhaust duct 86, which may have an outdoor outlet in order to prevent the operator of the device from respiring noxious gases.

By setting the chokes 82, 83, 84, 85 with the aid of the manually adjustable setting knobs 87, 88, 89, 90 the flow resistance from the interior of the stock containers to the atmosphere can be adjusted. By means of the gas pressure furnished by the diaphragm pump 44 an accurately determined flow rate can once be set for each separate stock container. It will be obvious that with regard to an optimum process control such an accurate, constant adjustment is of paramount importance.

With respect to the disposition of the ducts 78 to 81 and of the chokes 82 to 85 it is noted that for the sake of clarity of the drawing they are shown on the front side in FIG. 1. In practice they are located on the other side of the stock containers 6 to 9 in order to facilitate filling of the stock containers 7, 8 and 9.

FIG. 4 shows in further detail the structure of the developing drum 4. The three coaxial compartment 69, 70, 71 are separated by transverse partitions 91 and 92. The compartment 69 can be closed at its free end remote from the transverse partition 91 by a liquid-tight cover 93, which can provide a complete seal on a sealing ring 95 by means of a bayonet joint 94.

The second compartment 70 comprises a spiral-shaped wall 96 of about one and a half spiral turns or 540° around the rotary axis, the inner space 97 of said wall communicating in operation with the fluid ducts 64, 65, 66, 67 the exterior space 98 being closed at its end by a partition 99 and being in open communication through an orifice 100 in the transverse partition 91 with the first compartment 69.

The third compartment 71 also has a spiral-shaped wall 101 extending around the rotary axis, the outer end 102 of which is in open communication through a communication channel 103 extending along the circumferential edge of the second compartment 70 with the first compartment 69, whereas the interior space 104 is in open communication with a central outlet orifice 105. This central outlet orifice 105 opens out in the fluid inlet and outlet cap 68, which is connected in the manner shown in FIG. 1 with the outlet duct 21. Inside the third compartment 71, on the side remote from the active side of the wall 101, there is a space 130 not used for the developing process.

A weight 131 fastened to the drum jacket is arranged therein. By this weight 131 the drum equilibrium disturbed by the various elements disposed asymmetrically and eccentrically with respect to the drum wall is restored.

The first compartment 69 comprises a shell plate 106 covering the whole length thereof. The communication channel 103 adjoins below said shell plate 106.

Between the inner wall of the first compartment 69 and the shell plate 106 is located a helical rim 107, which adjoins the communication channel 103 for conducting away the fluid from the first compartment 69.

The operation of the device so far described will now be briefly explained. By energizing the pump 44 and by moving the active end 55 of the hollow piston rod 52 by energizing the step motor 54 pressurized gas is introduced into the corresponding stock containers 6, 7, 8 or 9 so that the fluid is moved from the container concerned into the inner space 97 of the spiral-shaped wall 96.

After the injection of the fluid into the second compartment 70 the fluid remains therein during the rotation 108. By the subsequent rotation 112 the fluid leaves the second compartment 70 and enters the first compartment 69, where it comes into contact with the photograph to be developed. Obviously the contact with the first processing fluid starts the development of the photograph. At the subsequent rotation 108 the fluid leaves the first compartment 69 and enters the third compartment 71, where it is conducted away through the spiral-shaped wall 101 via the outlet orifice 95. At the same time the next fluid is injected into the second compartment, after which the cycle described is repeated for the subsequent process step.

It should be noted that in this preferred embodiment rapid filling and evacuation occur only during the transient rotation 108.

Owing to gravity the various, spiral-shaped walls operate so to say like pumps.

FIGS. 5 and 6 show, though probably needless, a few structural details of the developing drum 4.

FIG. 8 shows a further embodiment 119 of a developing device in accordance with the invention. The difference from the developing device 1 shown in FIG. 2 resides in that as is shown in FIG. 8 the drive takes place on the top side of the drum 4 whereas this is done on the underside of the drum in FIG. 2. A motor 120 drives along rollers 121 a rope 122, which is further passed on a guide roller 123 and a reversing roller 124. The elements 120 to 124 are all arranged on a frame 125, which is pivotable about a hinge 126 fastened to the trough 2 between a working position indicated by solid lines and a rest position indicated by broken lines, in which the drum 4 can be removed from the device 119. In the device shown in FIG. 2 there is some risk of slip when the drum 4 is driven by the ropes 28 and 29. By performing the drive under pressure from the top slip is substantially excluded. The frame 125 can be locked in the working position by means not shown as indicated by solid lines.

Only FIG. 8 shows that in all embodiments shown the first space 3 is provided with a heating element 127 for controlling the temperature of the water 12 by means of a thermostat. In all embodiments the agitator 24 serves for obtaining optimally homogeneous temperatures.

The drawing does not show a central control-unit for controlling the rotation of the developing drum and for synchronously energizing the diaphragm pump 44 and the step motor 54.

FIG. 9 shows a stock container 132 having a closing cap 133. Through the top wall thereof are passed in sealing relationship a pressure duct 134 and a fluid duct 135. The duct 134 terminates on the side of the container 132. The duct 135 terminates near the bottom thereof. With the pressure duct 134 communicates a further pressure duct 136, which corresponds with the ducts 56, 57, 58, 59. The duct 135 corresponds with the ducts 64, 65, 66, 67. At the transition between the ducts 136 and 134 is provided a needle valve 137. By turning the knob 138 the passage between a seat 139 and a conical needle 140 can be varied. Thus a desired pressure drop can be obtained through the opening 141. The needle 140 is axially displaceable and is urged by a very light compression spring 145 towards the seat 139 with regard to the desired pressure formation. It should be noted that the valve 137 corresponds to the chokes 82, 83, 84, 85. It will be obvious that the opening 141 may communicate with an outlet duct, for example, the duct 86.

In the embodiment shown the closing cap has a screw joint 142 in common with the container 132. In order to prevent rotation a bayonet joint may be preferred.

By using a closing cap with the associated ducts the stock container can be more readily replaced, which enhances the flexibility of the device.

The trough 2 is preferably constructed or arranged in heat insulating fashion.

With respect to the disposition of the stock containers 6, 7, 8, 9 it should be noted that by means of a slot-and-pin coupling they may be guarded against lateral dispalcement, horizontal rotation and tilting.

The cap 68 may be bevelled at the top end towards the drum 4 for allowing the tilting movement of the drum 4.

FIG. 10 shows a heat exchanger 146 comprising parallel thin walled, long duct parts 147, which communicate through distribution drums 148, 149 with the stock container 9 containing the developer and the injection piece 67 respectively. The heat exchanger 146 is located in the space 3 below the drum 4. This configuration implies an extreme accuracy of the temperature of the developer introduced into the drum 4. For the other fluids such accuracy is not necessary.

It will be obvious that the embodiments described and illustrated are only examples for illustrating the principles of the invention. Many modifications of components and of their relationship may be carried out without exceeding the scope of the invention.

I claim:

1. Apparatus for developing photographic film, which comprises a drum adapted to contain film to be developed, a plurality of fluid containers for the developing process, said drum having first compartment means for containing the film to be developed, second compartment means for transferring fluid therein by gravity flow to said first compartment means only in response to rotational movement of said drum from a first rotational position to a second rotational position of said drum, and third compartment means for receiving fluid by gravity flow from said first compartment means only in response to rotational movement of said drum from said first rotational position to a third rotational position of said drum and for discharging fluid from the third compartment means in response to rotational movement of said drum between said third position and said first position, control means for transferring fluid from a fluid container to said second compartment means while said drum is in said first position thereof and rotating said drum to said second position to charge said first compartment means with such fluid and then back to said first position, for thereafter rotating said drum from said first position to said third position to empty such charge of fluid from said first compartment means to said third compartment means, and for rotating said drum from said third position back to said first position while discharging fluid of such charge to drain from said third compartment means.

2. Apparatus as defined in claim 1 including water bath means for at least partially immersing said drum and said fluid containers in water of controlled temperature during the entire development process.

3. Apparatus for developing photographs, comprising a fluid bath, a developing drum disposed in said fluid bath and adapted to be heated thereby, drive means for rotatably driving said drum about its longitudinal axis, a plurality of stock containers for supplying fluids to and from said drum, the drum and all of said stock containers being disposed in said fluid bath and held therein during the entire developing process, said developing drum comprising three coaxial compartments separated by transverse partitions, the first compartment serving to receive the photograph or photographic strip to be developed and being closed for this purpose at its free end remote from the transverse partition by a light- and liquid-tight cover, the second compartment comprising means for supplying the fluids required for development in a light-tight manner, while the second and third compartments comprise means for the supply and evacuation of the used fluids in a light-tight manner, the second compartment comprising a spiral-shaped wall of more than 360° around the drum axis, the interior space of which second compartment communicates with one or more inlet ducts for the or all fluids required for development and the exterior space of which is closed at its end by a partition and is in open communication through an orifice in the transverse partition with the first compartment and in that the third compartment also comprises a spiral-shaped wall around the drum axis, the outer end of which is in open communication through a communication channel extending through the second compartment along the circumferential wall thereof with the first compartment and the inner space of which is in open communication with a central outlet orifice.

4. Apparatus as defined in claim 3 wherein said stock containers may be subjected to gas pressure and including selecting and dosing means for the successive supplies at will and in desired amounts of the fluids required for the development to the second compartment.

5. Apparatus as defined in claim 4 wherein said stock containers may be selectively connected with a common gas pressure source and each of them communicates through an adjustable choke, leakage valve or ballast valve with the atmosphere.

6. Apparatus as defined in claim 3 wherein the stock containers are adapted to float.

7. Apparatus as defined in claim 3 including a central control unit for controlling the rotations of the developing drum and the synchronous energization of the selecting and dosing means.

8. Apparatus as defined in claim 3 including fluid ducts connected with the stock containers and located by a large part of their length in a liquid bath heating the drum.

9. Apparatus as defined in claim 8 wherein the fluid duct for at least the developer has a number of parallel-connected, thin-walled duct portions.

10. Apparatus for developing photographic film, which comprises a horizontally disposed drum mounted for rotation about its longitudinal axis and having a discharge passage at one end thereof, means for rotating said drum to a plurality of different rotational positions with respect to a developing position thereof, and means for supplying developing fluid to the drum; said drum having first compartment means addpted to contain film to be developed, second compartment means adapted to receive developing fluid from said means for supplying, and third compartment means adapted to receive used developing fluid from said first compartment means, said first and second compartment means being in fluid communication in response to rotational movement of said drum to transfer fluid from said second compartment means to said first compartment means so that film in the first compartment means will be immersed in developing fluid while said drum is in said developing position, said first and third compartment means being in fluid communication in response to movement of the drum from said developing position to transfer used developing fluid from said first compartment means to said third compartment means, and said third compartment means being in fluid communication with said discharge passage in response to rotational movement of said drum to said developing position thereof.

11. Apparatus as defined in claim 10 including water bath means for immersing said drum in heated water to a level below said discharge passage.

12. Apparatus as defined in claim 11 wherein said means for supplying includes at least one container having developing fluid therein, said container being at least partially immersed in the heated water of said water bath means.

13. Apparatus as defined in claim 12 wherein said container is immersed in floating relation in said water bath means.

14. Apparatus as defined in claim 10 wherein said drum is oscillated back and forth from said fixed, developing position.

15. Apparatus as defined in claim 14 wherein said first, second and third compartment means are axially spaced along the length of said drum.

16. Apparatus as defined in claim 15 including water bath means for immersing said drum in heated water to a level below said discharge passage.

17. Apparatus as defined in claim 16 wherein said means for supplying includes at least one container having developing fluid therein, said container being at least partially immersed in the heated water of said water bath means.

18. Apparatus as defined in claim 17 wherein said container is immersed in floating relation in said water bath means.

19. Apparatus for developing photographs which cmprises the combination of:

water bath means for containing heated water;

a developing drum having a discharge passage at one end thereof and disposed horizontally in said water bath means and rotatably mounted therein for rotation about its longitudinal axis, said drum having a sequential series of compartment means for receiving, transferring and discharging developing fluid within and from said drum, said compartment means comprising an outlet compartment means located at said one end of the drum, an inlet compartment means located adjacent said outlet compartment means and a developing chamber compartment means adapted to contain film to be developed and located remote from said one end of the drum;

means for supplying developing fluid to said inlet compartment means through said one end of the drum; and means for oscillating said drum relative to a developing position thereof in which film disposed in said developing chamber compartment means is immersed in developing fluid, to:

(i) transfer developing fluid from said inlet compartment means to said developing chamber compartment means, (ii) transfer used developing fluid from said developing chamber compartment means to said outlet compartment means, and (iii) discharge used developing fluid from said outlet compartment means through said discharge passage.

20. Apparatus as defined in claim 19 wherein said inlet compartment means and said outlet compartment means each contain scroll-like walls centered on the longitudinal axis of the drum.

21. Apparatus as defined in claim 20 wherein said outlet compartment means includes a duct communicating from within the confines of the scroll-like wall thereof to said developing chamber compartment means.

22. Apparatus as defined in claim 21 wherein said developing chamber compartment means includes a wall separating such compartment means from said inlet compartment means and having an opening therein communicating within the confines of the scroll-like wall of the inlet compartment means.

23. Apparatus as defined in claim 20 wherein said developing chamber compartment means includes a wall separating such compartment means from said inlet compartment means and having an opening therein communicating within the confines of the scroll-like wall of the inlet compartment means.

24. Apparatus as defined in claim 19 wherein said means for supplying comprises a plurality of separate containers for different fluids, said containers being at least partially immersed in the water bath means.

* * * * *